US010193204B2

(12) United States Patent
Witte et al.

(10) Patent No.: US 10,193,204 B2
(45) Date of Patent: Jan. 29, 2019

(54) COMBINER, A POWER DIRECTIONAL COUPLER AND A METHOD FOR MANUFACTURING A POWER DIRECTIONAL COUPLER AND A COMBINER

(71) Applicant: Rohde & Schwarz GmbH & Co. KG, Munich (DE)

(72) Inventors: Marco Witte, Berlin (DE); Knut Laurisch, Berlin (DE); Christian Riedel, Grafling (DE); Rudolf Weinberger, Gotteszell (DE); Stefan Fritz, Teisnach (DE); Lothar Schenk, Berlin (DE)

(73) Assignee: Rohde & Schwarz GMBH & Co. KG, Munich (DE)

( * ) Notice: Subject to any disclaimer, the term of this patent is extended or adjusted under 35 U.S.C. 154(b) by 75 days.

(21) Appl. No.: 15/229,943

(22) Filed: Aug. 5, 2016

(65) Prior Publication Data

US 2017/0093014 A1 Mar. 30, 2017

(30) Foreign Application Priority Data

Sep. 25, 2015 (EP) ..... 15186919

(51) Int. Cl.
*H01P 5/18* (2006.01)
*H01P 5/12* (2006.01)
*H01P 11/00* (2006.01)

(52) U.S. Cl.
CPC ..... *H01P 5/182* (2013.01); *H01P 11/001* (2013.01)

(58) Field of Classification Search
CPC ..... H01P 5/181; H01P 5/182; H01P 11/002
USPC ..... 333/109, 113
See application file for complete search history.

(56) References Cited

U.S. PATENT DOCUMENTS 2,701,341 A 2/1955 Bowen
2,817,063 A * 12/1957 Kurtz ..... H01P 5/182 333/113
3,899,756 A * 8/1975 Bodonyi ..... H01P 9/003 333/110
4,679,011 A * 7/1987 Praba ..... H01P 5/182 333/111

(Continued)

FOREIGN PATENT DOCUMENTS

CN 201 820 867 U 5/2011

OTHER PUBLICATIONS

Beyer et al, "Compact Top-Wall Hybrid/Coupler Design for Extreme Broad Bandwidth Applications," 2005 IEEE MTT-S International Microwave Symposium, Piscataway, NJ, USA IEEE, Jun. 12, 2005, pp. 1227-1230, XP010844847, 4 pages.

(Continued)

*Primary Examiner* — Dean Takaoka
(74) *Attorney, Agent, or Firm* — Schwabe, Williamson & Wyatt, P.C.

(57) ABSTRACT

A power directional coupler is described which comprises two hollow conductors and a separation wall. Said separation wall has a coupling portion which comprises several holes which are arranged in said separation wall such that a high hole-wall relation is obtained, ensuring a good coupling at a small size of said power directional coupler. Further, a combiner and a method for manufacturing said power directional coupler and a combiner are described.

11 Claims, 4 Drawing Sheets

(56) References Cited

U.S. PATENT DOCUMENTS

| | | | | |
|---|---|---|---|---|
| 5,013,979 | A * | 5/1991 | Birleson | H01Q 3/22 342/372 |
| 5,218,327 | A * | 6/1993 | Calabrese | H01P 5/04 333/111 |
| 5,247,268 | A * | 9/1993 | Meise | H01P 5/04 333/111 |
| 7,821,355 | B2 * | 10/2010 | Engel | H01P 1/211 333/117 |
| 7,859,361 | B2 * | 12/2010 | Evers | H01P 5/184 333/109 |
| 8,446,230 | B2 * | 5/2013 | Cisco | H01P 5/185 333/109 |
| 2007/0139135 | A1 * | 6/2007 | Ammar | H01P 1/2138 333/135 |

OTHER PUBLICATIONS

Wang et al, "Simulation study of a waveguide power combining network," 2013 Proceedings of the International Symposium on Antennas & Propagation, Antenna Society of the Chinese Institute of Electronics, vol. 2, Oct. 23, 2013, pp. 768-770, XP032554308, 3 pages.

European Search report, EP 15186919.5, dated Mar. 31, 2016, 9 pages.

* cited by examiner

COMBINER, A POWER DIRECTIONAL COUPLER AND A METHOD FOR MANUFACTURING A POWER DIRECTIONAL COUPLER AND A COMBINER

CROSS-REFERENCE TO RELATED APPLICATIONS

This application claims priority to EP Application No. 15 186 919.5 filed Sep. 25, 2015, the entire disclosure of which is incorporated herein by reference.

FIELD OF THE INVENTION

The invention relates to a combiner, a power directional coupler and a method for manufacturing a power directional coupler and a combiner.

BACKGROUND

Directional couplers are passive components used in the field of high frequency engineering for splitting, decoupling or coupling electromagnetic waves. Several directional couplers can be used to form a combiner which is also called cascaded power combiner as its several directional couplers are usually combined in a cascaded manner.

One kind of power directional coupler comprises two hollow conductors which are also called wave guides, hollow wave guides, rectangular wave guides, HF-wave guides, hollow-metallic wave guides, etc. Hereinafter, the term hollow conductor is used for such an item. The hollow conductors are typically brazed or welded together along two side walls facing each other. These side walls are perforated in order to provide a coupling portion for the electromagnetic waves. The coupling portion has many holes and/or slits wherein the number of holes and/or slits increases dramatically when a tight coupling shall be achieved with the power directional coupler, for instance a 3 dB coupling. At frequencies higher than 10 GHz such a power directional coupler can be operated with powers up to 400 W or more in contrast to coaxial or printed (PCB) couplers which can only be operated with low power.

In general, the size and the position of the holes and/or slits result from a complex function which further complicates the manufacturing of the power directional coupler significantly. This also applies for the manufacturing of a combiner comprising several power directional couplers.

Further, the combiner needs a lot of space due to the many holes and/or slits of each power directional coupler when 3 dB power directional couplers are used.

DISCLOSURE OF INVENTION

The invention provides a power directional coupler comprising two hollow conductors and a separation wall wherein the separation wall is positioned between both hollow conductors. The separation wall has a coupling portion which comprises several holes arranged in the separation wall such that a high hole-wall relation is obtained, ensuring a good coupling at a small size of the power directional coupler.

Further, the invention provides a combiner comprising several power directional couplers mentioned above.

The invention is based on the finding that the size of a power directional coupler can be minimized when holes are arranged within the separation wall such that the relation of the portion of the separation wall provided with holes and the portion of the separation wall provided with wall material is increased. This relation is called hole-wall relation wherein the value is maximized, preferably. For instance, the hole-wall relation can be higher than 50%, particularly higher than 70%, preferably higher than 80%, more preferably higher than 90%. According to the invention, the number of holes in the separation wall can be reduced whilst maintaining the coupling quality because of the size and shape of the coupling portion.

The separation wall has a coupling portion which comprises the several holes. Both hollow conductors are coupled to each other within the coupling portion in order to split, couple or decouple electromagnetic waves. Accordingly, the length of the coupling portion is short compared to typical coupling portions of power directional couplers. In general, the length of the coupling portion depends on the frequency. Also, the size and the distance of the holes depend on the frequency. The distance between two adjacent holes is preferably a quarter wavelength. Even though the coupling portion is very short, a tight coupling of the hollow conductors can also be ensured due to the reduced dimensions of the narrow sides. "Tight coupling" here means a coupling with low losses, for instance 3 dB or less, wherein the output at the coupled exit of the power directional coupler is high.

The hollow conductors themselves can also be minimized, in particular their narrow sides and their length, since the electromagnetic waves are "pressed" through the holes when the narrow sides of the hollow conductors are reduced with respect to conventional dimensions. Such a power directional coupler can replace a microstrip coupler or coaxial coupler which cannot be operated with high power.

The number of holes can be reduced as they are arranged in short distance to each other in order to ensure the high hole-wall-relation.

The hollow conductors here are, as usual, made of metal such that the electromagnetic waves propagate between the metallic walls of the hollow conductors wherein the metallic walls surround a hollow space which can be filled with air. Preferably, the separation wall is also made of metal.

Alternatively, the hollow conductors can be made by a synthetic material, e.g. plastic, which material is covered with an electrically conductive material afterwards, for instance a metal, such that the hollow conductors have an electrically conductive surface. The metal can be deposited by evaporation deposition.

Accordingly, a dielectric medium is not necessary as conventional hollow conductors can be used wherein the electromagnetic waves are confined by their metallic or electrically conductive walls. However, the dimensions of the hollow conductors can be reduced with respect to the dimensions of conventional hollow conductors, in particular the narrow sides of the hollow conductors. Thus, the size of the combiner is also minimized with respect to a conventional one.

Generally, the hole-wall-relation, the size of the narrow sides of the hollow conductors and the length of the hollow conductors are adapted to each other such that the overall dimensions can be reduced, particularly the length and the size of the narrow sides, when a high hole-wall-relation is obtained.

According to one specific embodiment, the length of the coupling portion is between 10 mm and 80 mm, preferably between 30 mm and 50 mm. This embodiment is directed to a power directional coupler for 15 GHz (KU-Band).

In general, a combiner can be realized which can be inserted into a standard 19"-slot of a rack because of the minimized design of the power directional coupler even though the combiner comprises several power directional couplers, a circuit board and a power supply.

In particular, the narrow and long sides of the cross section of the hollow conductors have a relation lower than 1:2, preferably 1:4 or lower. This relation of the hollow conductors ensures small dimensions of the hollow conductors, in particular their length. Even though the dimensions of the hollow conductors, in particular the cross section and the length, are reduced, a tight coupling can be ensured because of the increased hole-wall relation.

According to another aspect of the invention, the power directional coupler comprises at least one base element which comprises both hollow conductors at least partly, in particular one half of each hollow conductor. The base element can be manufactured by milling such that the whole power directional coupler can be manufactured in a cost-efficient manner.

Particularly, two base elements are provided which are connected to each other forming the hollow conductors. The power directional coupler can be formed by two base elements wherein the connecting plane of both base elements is in the middle of the long side of each hollow conductor. Accordingly, the power directional coupler can be divided in the middle. This location for the connecting plane is preferred as the current density is very low in the middle of the long side of a hollow conductor. Thus, inevitable manufacturing tolerances and slits occurring during manufacturing have no influence on the performance of the power directional coupler.

Preferably, both base elements are mirror-inverted such that the production of the power directional coupler is simplified as only one type of base element is necessary.

The separation wall may be at least partly connected to the base element, in particular one half of the separation wall. Generally, the separation wall or at least a part of it, in particular one half of the separation wall, may be formed as a part of a separately manufactured insert which further has a connecting portion being attached to the base element. This insert can have the shape of a "T" such that at least one half of the separation wall extends vertically from the connecting portion, in particular from the middle of the connecting portion.

The part of the separation wall can be laser-welded, glued or otherwise connected to the base element. This depends inter alia on the chosen material.

Alternatively, the separation wall halves are integral parts of the base element such that the separation wall halves are also manufactured by milling. The holes are at least pre-milled during the manufacturing of the base elements. Thus, the separation wall is dividable into two halves wherein each of the halves is formed as a part of one base element such that the separation wall is completed when both base elements are connected to each other. The connecting plane of both base elements is also the same for the separation wall, in particular its halves.

According to another aspect, the holes are arranged in two rows such that hole pairs are provided. This enables a tight coupling by minimized dimensions as several holes are provided at shortest distance. Each half of the separation wall comprises one row wherein the completed separation wall has two rows after the step of connecting both base elements.

According to one specific embodiment, the holes have a rectangular shape and/or the same size. Holes with this shape can be manufactured easily and provides a good coupling. Further, the manufacturing can be simplified as the size and position of the holes do not follow a complex function.

Alternatively, the holes can have another shape and/or different sizes.

Further, the invention provides a method for manufacturing a power directional coupler as described above, wherein two base elements are pre-manufactured which each comprises the hollow conductors partly, in particular one half of each hollow conductor, and wherein the base elements are connected to each other in a superposed manner. Accordingly, the power directional coupler can be divided in the middle. This ensures that inevitable manufacturing tolerances and slits occurring during manufacturing have no influence on the performance of the manufactured power directional coupler.

Particularly, both base elements are provided with a part of the separation wall, in particular one half of the separation wall. Inevitable manufacturing tolerances and slits occurring during manufacturing of the separation wall whilst connecting the parts of the separation wall, in particular the halves, have no influence on the performance of the manufactured power directional coupler.

According to another aspect of the invention, both base elements are connected to each other in a connecting plane which intersects the hollow conductors exactly in the middle of their long sides. This location for the connecting plane is preferred as the current density is very low in the middle of the long side of a hollow conductor.

In addition, the holes may be at least end-machined by electro-discharge machining (EDM). The holes may be pre-milled during the manufacturing of the base element, in particular when the separation wall or at least a part of it is formed as a part of the base element. Afterwards, the exact size and shape of the holes are provided by EDM very precisely. The holes can also be end-machined by EDM when at least one half of the separation wall is manufactured separately and afterwards attached to the base element.

Further, the invention provides a method for manufacturing a combiner wherein two base elements are pre-manufactured which each comprises several hollow conductors partly, in particular one half of each hollow conductor, and wherein the base elements are connected to each other in a superposed manner. The combiner can be manufactured in a similar manner as one power directional coupler due to the small dimensions of the power directional couplers.

BRIEF DESCRIPTION OF DRAWINGS

The invention will now be described with reference to a preferred embodiment which is shown in the enclosed drawings. In the drawings, FIG. 1 schematically shows a power directional coupler according to one specific embodiment of the invention.

DETAILED DESCRIPTION OF EXAMPLES EMBODIMENTS

Figure 1:
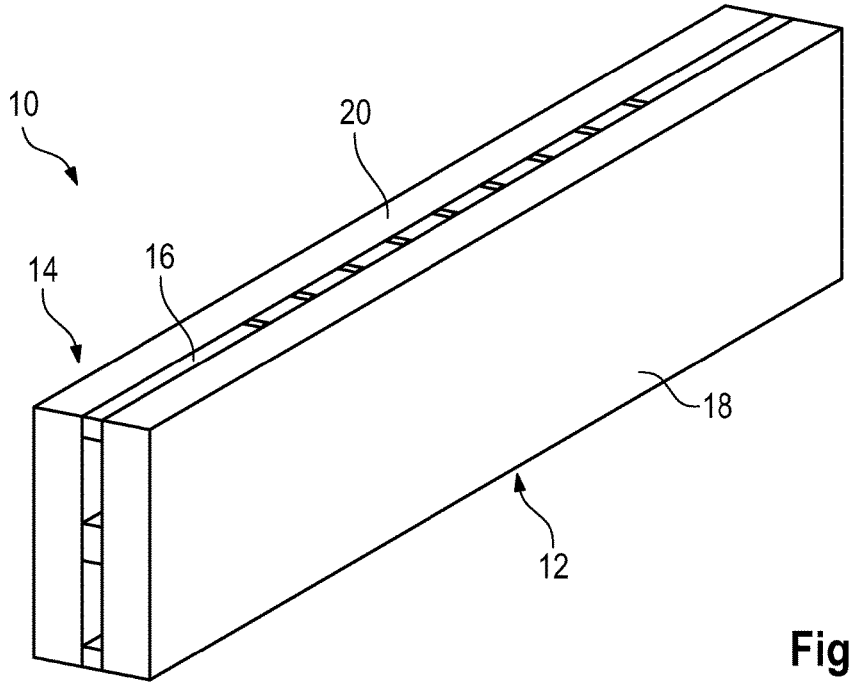

FIG. 1 schematically shows a power directional coupler 10 according to one specific embodiment. In general, the power directional coupler 10 comprises two hollow conductors 12, 14 and a separation wall 16 provided between the hollow conductors 12, 14.

The hollow conductors 12, 14 each have metallic side walls which are not being illustrated in FIG. 1. Alternatively, the hollow conductors 12, 14 can be made of a synthetic material, on the surface of which is deposited an electrically conductive material, e.g. by evaporation deposition. Each hollow conductor 12, 14 has a hollow space 18, 20 through which electromagnetic waves can propagate. The hollow spaces 18, 20 are surrounded by the metallic or electrically conductive walls of the hollow conductors 12, 14 and can be filled with air.

As can be seen in FIG. 1, the narrow sides of the hollow conductors 12, 14 are formed narrower as compared with the dimensions of conventional hollow conductors. In the shown embodiment, the relation of the narrow sides and the long sides of the cross-section of the hollow conductors 12, 14 is 1:4. However, smaller relations are also possible, for instance 1:5 or 1:6.

Figure 2:
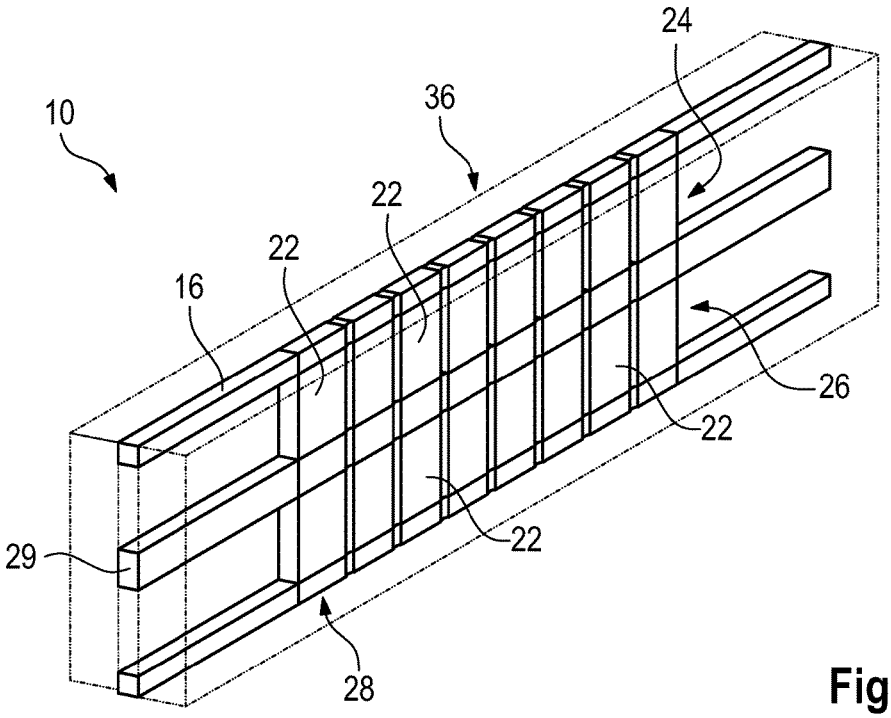
FIG. 2 shows the power directional coupler of FIG. 1 with transparent hollow conductors.

In FIG. 2, the power directional coupler 10 of FIG. 1 is shown wherein the hollow conductors 12, 14, in particular their hollow spaces 18, 20, are not shown such that the separation wall 16 of this specific embodiment is shown in detail.

In this embodiment, the separation wall 16 comprises several holes 22 which are of the same rectangular size, in particular square. In total, two rows 24, 26 of holes 22 are formed in the separation wall 16 such that hole pairs 28 are provided. In the shown embodiment, eight hole pairs 28 are provided.

The separation wall 16 comprises a crossbar 29 between the rows 24, 26.

However, other arrangements, shapes and/or sizes of the holes 22 are also possible as long as a tight coupling on short distance is provided. In general, the design of the separation wall 16, in particular the holes 22, depends on the bandwidth.

The distance of adjacent holes 22 is a quarter wavelength of the respective bandwidth.

Figure 3:
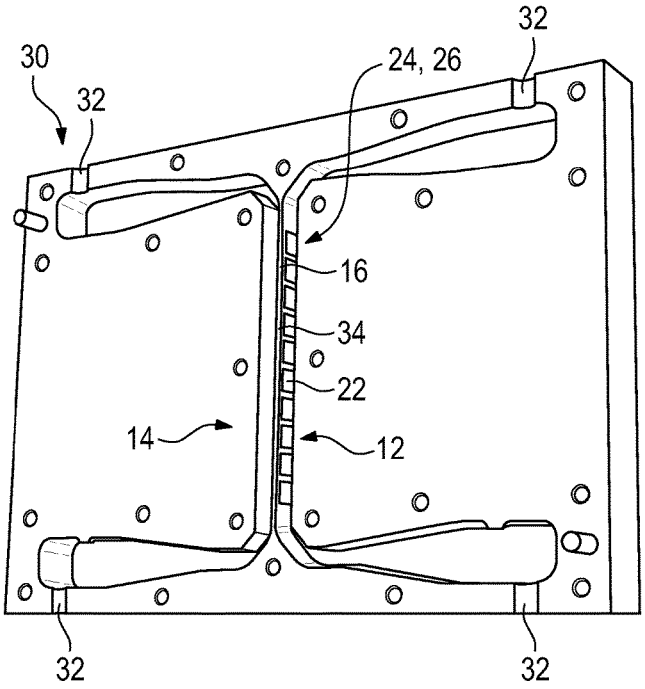
FIG. 3 shows a base element according to one embodiment used for manufacturing the power directional coupler according to the invention.
Figure 4:
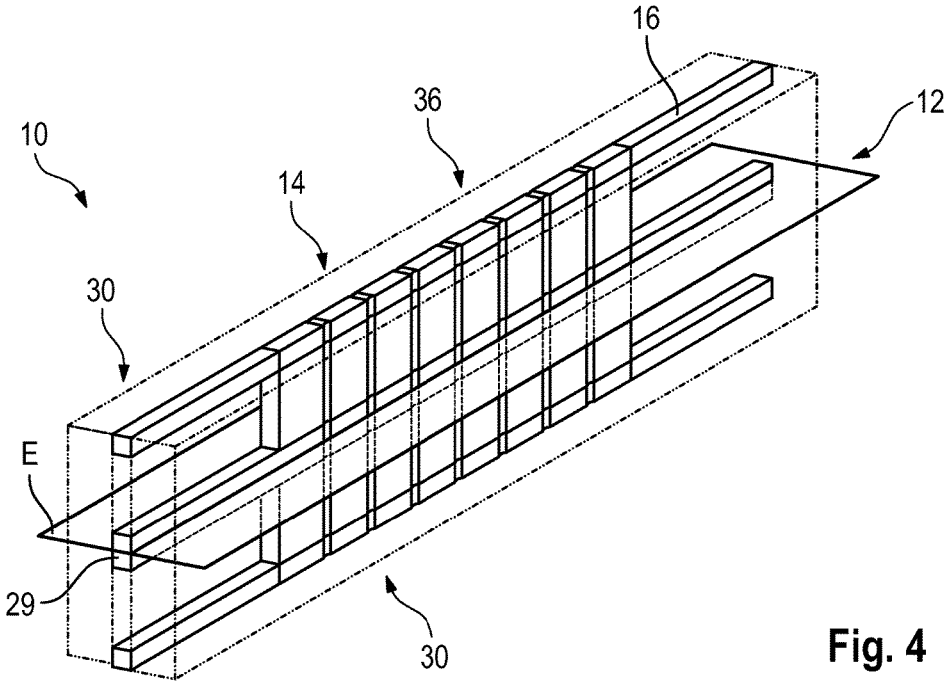
FIG. 4 shows a view similar to FIG. 2, with an additional connecting plane being shown for explanation purposes, FIG. 5 schematically shows a part of the separation wall used by the power directional coupler of FIGS. 1 to 2, FIG. 6 schematically shows in the power directional coupler of FIGS. 1 and 2 in a cross-sectional view partly.

According to a preferred embodiment, the power directional coupler 10 is formed by two base elements 30 which can be arranged in a superposed manner in order to provide the power directional coupler 10. One of these base elements 30 is shown in FIG. 3. The completed power directional coupler 10 made of two base elements 30 is schematically shown in FIG. 4 wherein a connecting plane E is shown.

The base element 30 shown in FIG. 3 differs from the one of FIGS. 1 and 2 as one row 24, 26 comprises ten holes 22 instead of eight holes 22 as shown in FIGS. 1 and 2. This reveals that the number of holes 22 is modifiable according to embodiment and the purposes.

The connecting plane E is exactly in the middle of the hollow conductors 12, 14, and the separation wall 16 as will be described later.

In the shown embodiment, the base element 30 comprises one half of each hollow conductor 12, 14 wherein the hollow connectors 12, 14 each have two half ports 32 at their ends, respectively. Thus, each base element 30 has four half ports 32. When both base elements 30 are connected to each other, the hollow conductors 12, 14 as well as the four ports 32 are completely established.

Further, each base element 30 comprises one half 34 of the separation wall 16 which is also completed when both base elements 30 each comprising one half 34 of the separation wall 16 are connected to each other. The two halves 34 of the separation wall 16 are also mated in the connecting plane E.

The completed separation wall 16 provides a coupling portion 36 which is used for splitting, coupling or decoupling the electromagnetic waves propagating through the hollow conductors 12, 14. The coupling portion 36 is the portion of the separation wall 16 which is effective between the hollow conductors 12, 14. Accordingly, the size of the power directional coupler 10 can be reduced when the length of the coupling portion 36 is reduced.

In general, the holes 22 are provided in the coupling portion 36 such that a tight coupling at short distance is obtained. This is ensured by maximizing the hole-wall-relation which means the relation of the portion of holes 22 and wall material within the coupling portion 36. This hole-wall-relation is higher than 50%, in particular higher than 70%, preferably higher than 80%, more preferably higher than 90%.

Worded differently, a hole-wall-relation of 90% means that the surface of the holes is 90% of the surface of the wall of the coupling portion.

As shown in FIG. 3, each half 34 of the separation wall 16 has one of both rows 24, 26 of the holes 22.

Thus, the separation wall 16 comprising the coupling portion 36 is formed by two halves 34 which are coupled together.

According to one embodiment, the base elements 30 can be manufactured by milling wherein the separation wall 16 and its holes 22 can be pre-milled during the manufacturing of the base elements 30. Afterwards, the holes 22 can be end-machined by EDM in order to ensure the exact shape of the holes 22 precisely.

After end-machining, both base elements 30 are connected to each other in the connecting plane E as shown in FIG. 4.

Alternatively, the separation wall 16, in particular both halves 34, can be manufactured separately and attached to the base elements 30. Afterwards, both base elements 30 are connected to each other in a similar manner.

In general, both hollow conductors 12, 14 are divided exactly in the middle of their long sides. This position is preferable as the current density of the electromagnetic waves is almost zero within the hollow conductors 12, 14 in the middle of their long side. Thus, manufacturing tolerances or tolerances during mating of the two base elements 30 have no influence on the transmission.

Further, no additional sealing for compensating tolerances and improving transmission characteristics, is necessary for the connected base elements 30 because of the position of the connecting plane E. Such an additional sealing would increase the manufacturing costs due to the additional work.

Figure 5:
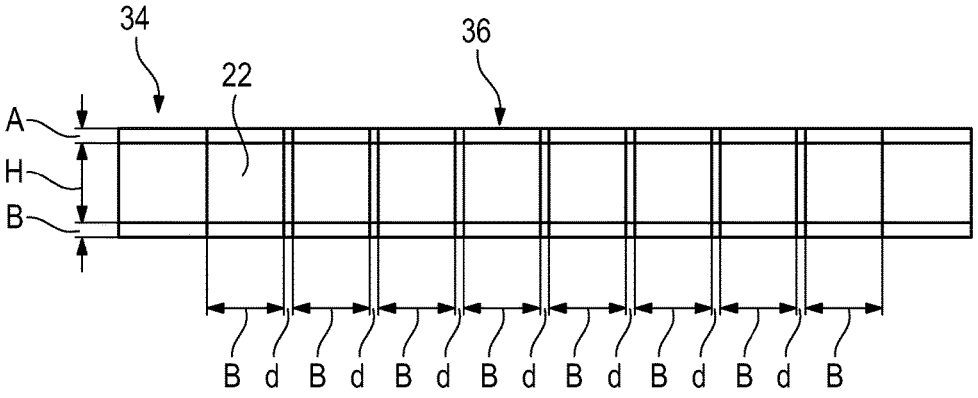

In FIG. 5, one half 34 of the separation wall 16 provided in one of the base elements 30 is shown in detail in a side view.

According to the specific embodiment directed to 15 GHz, the holes 22 have a rectangular shape, in particular a square one. In the shown embodiment, the holes 22 have a width B of 4.5 mm and a height H of 4.5 mm wherein the distance d between two adjacent holes 22 is 0.5 mm. The upper and lower edges of the half 34 each have a height A, B of 1 mm. When both base elements 30 are connected to each other during the manufacturing process, the holes 22 of one hole pair 28 of the completed separation wall 16 are distanced from each other by 2 mm.

Accordingly, the coupling portion 36 being effectively used between both hollow conductors 12, 14 has a length of 39.5 mm in this embodiment.

In general, different sizes, shapes and distances between adjacent holes 22 can be provided. This depends inter alia on the frequency as the distance between adjacent holes 22 should be a quarter wavelength of the respective frequency.

Figure 6:
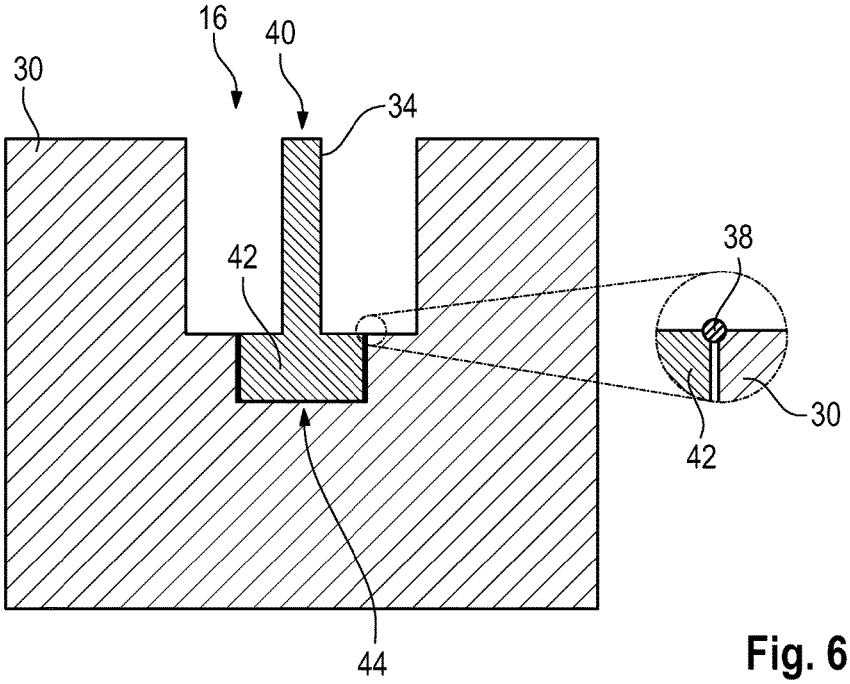

In FIG. 6, a cross section of FIG. 1 is shown. The shown cross section is the same as the one of FIG. 3.

It can be seen that at least the half 34 of the separation wall 16 is separately manufactured and afterwards inserted into the base element 30 and attached thereto. In the shown embodiment, the half 34 of the separation wall 16 is laser welded. Accordingly, a laser-weld bead 38 is shown (magnified part).

Alternatively, the half 34 of the separation wall 16 can be glued or otherwise connected to the base element 30.

Each half 34 is part of an insert 40 which also comprises a connecting portion 42 being perpendicular to the half 34 of the separation wall 16 which extends from the middle of the connecting portion 42 upwardly.

The connecting portion 42 is received by a recess 44 in the base element 30 wherein the connecting portion 42 is laser welded to the base element 30 in order to attach the half 34 of the separation wall 16 to the base element 30.

Afterwards, both pre-assembled base elements 30 are connected to each other in the connecting plane E in order to provide both hollow conductors 12, 14 and the separation wall 16 completely.

Alternatively, the base element is higher and the complete separation wall 16 is inserted and attached to the base element wherein the complete separation wall 16 has all holes 22, in particular both rows 24, 26. Afterwards, the base element is closed by a cover in order to close the hollow conductors 12, 14.

In another alternative embodiment, the halves 34 of the separation wall 16 are manufactured during the milling of the base elements 30 such that the base elements 30 each comprise an integrated half 34 of the separation wall 16. The holes 22 can be pre-milled during the manufacturing and afterwards end-machined by EDM.

In general, the base element 30 can be part of a cooling element of a power amplifier. In particular the power base element 30 is milled in the cooling element.

Figure 7:
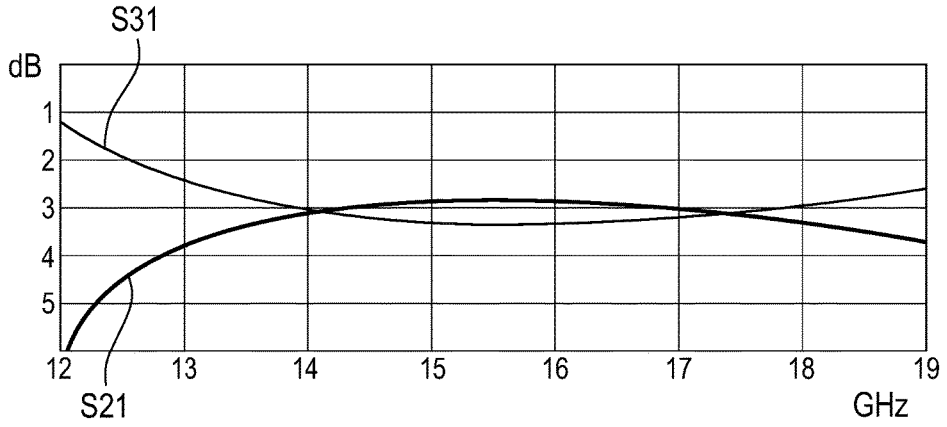
FIG. 7 shows a diagram representing the transmission of the power directional coupler according to one embodiment.

In FIG. 7, a transmission diagram showing the insertion loss (S21) and the coupling loss (S31) for several frequencies using such a power directional coupler 10 according to one embodiment of the invention.

It can be seen that the power directional coupler 10 has low losses and good transmission properties and thus a tight coupling, in particular two 3 dB coupling points at about 14.2 GHz and 17.4 GHz as well as a tight coupling between these 3 dB coupling points. Accordingly, a tight coupling over a wide range is obtained due to the crossbar 29 (FIG. 2) between the two rows 24, 26 of holes 22.

A typical 3 dB coupler without such a separation wall 16 having the high hole-wall-relation would only have one coupling point at a predetermined frequency.

Figure 8:
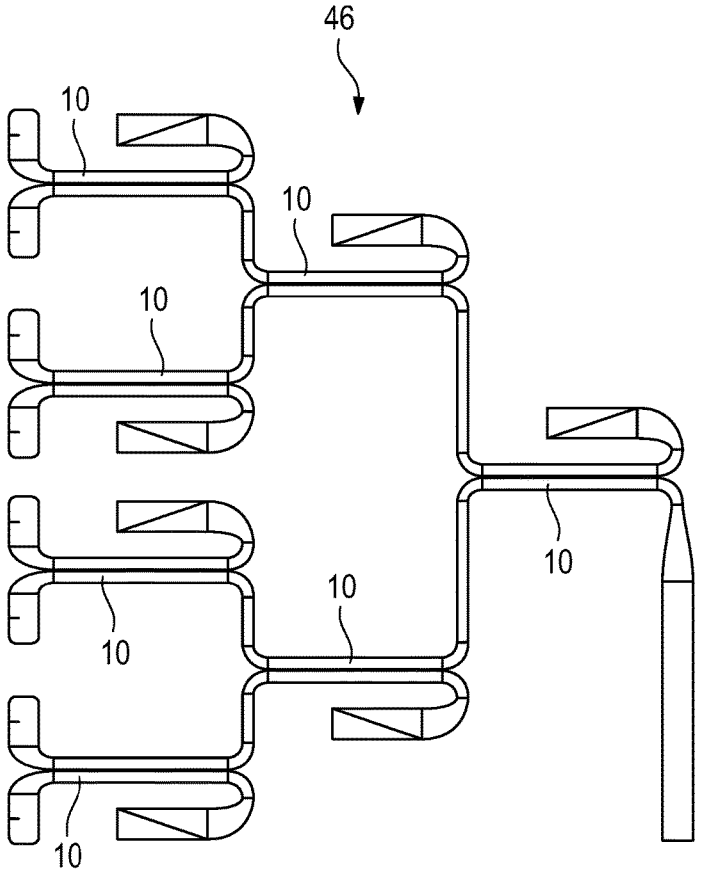
FIG. 8 shows a combiner according to the invention, in which several power directional couplers are combined.

FIG. 8 schematically shows a combiner 46 comprising several power directional couplers 10 being coupled to each other in a cascaded manner. In the shown embodiment, seven power directional couplers 10 are provided.

This combiner 46 can be realized by two base elements 30 comprising the halves of the seven power directional couplers 10 as described above. Thus, the cascaded combiner 46 can have a size of 200 mm×200 mm and can be inserted into a 19"-slot.

In general, a minimized power directional coupler 10 and a minimized combiner 36 are provided which are easy to manufacture in a cost-efficient manner.

The invention claimed is:

1. A power directional coupler, comprising two hollow conductors and a separation wall, said separation wall being positioned between both hollow conductors, said separation wall has a coupling portion which comprises several holes which are arranged in said separation wall such that a hole-wall relation is obtained, wherein two base elements are superimposed and connected together to form the two hollow conductors and at least one of the two base elements comprises one half of each of the two hollow conductors, wherein said holes are arranged in two rows such that hole pairs are provided.

2. The power directional coupler according to claim 1, wherein narrow and long sides of a cross section of said hollow conductors have a relation lower than 1:2, and preferably 1:4 or lower.

3. The power directional coupler according to claim 1, wherein one half of said separation wall is at least partly formed by each of said base elements.

4. The power directional coupler according to claim 1, wherein said holes are at least end-machined by electro-discharge machining (EDM).

5. The power directional coupler according to claim 1, wherein said holes have a rectangular shape and/or the same size.

6. A combiner comprising several power directional couplers according to claim 1.

7. A method for manufacturing a combiner according to claim 6, wherein two base elements are pre-manufactured which each comprises parts of several hollow conductors, in particular one half of each of the several hollow conductors, and wherein said base elements are connected to each other in a superposed manner.

8. A method for manufacturing a directional coupler, comprising:

forming two hollow conductors in two base elements, wherein the two base elements are pre-manufactured and each comprises one half of each of the two hollow conductors;

forming a separation wall in the two base units between the two hollow conductors;

forming a coupling portion in said separation wall which comprises several holes; and superimposing and connecting together the two base elements to form the two hollow conductors, wherein said holes are arranged in two rows such that hole pairs are provided.

9. The method according to claim 8, wherein both base elements form a part of said separation wall, in particular one half of said separation wall.

10. The method according to claim 8, wherein both base elements are connected to each other in a connecting plane which intersects said hollow conductors exactly in the middle of their long sides.

11. The method according to claim 8, wherein said holes are at least end-machined by electro-discharge machining (EDM).

* * * * *